US009217321B2

(12) United States Patent
Marvel

(10) Patent No.: US 9,217,321 B2
(45) Date of Patent: Dec. 22, 2015

(54) SYSTEM AND METHOD OF COILED TUBING DEPTH DETERMINATION

(75) Inventor: Chris Andrew Marvel, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 835 days.

(21) Appl. No.: 13/460,387

(22) Filed: Apr. 30, 2012

(65) Prior Publication Data

US 2013/0284434 A1 Oct. 31, 2013

(51) Int. Cl.
*E21B 47/04* (2012.01)

(52) U.S. Cl.
CPC ..... *E21B 47/04* (2013.01)

(58) Field of Classification Search
CPC ..... E21B 47/04; E21B 47/09
See application file for complete search history.

(56) References Cited

U.S. PATENT DOCUMENTS

| | | | | |
|---|---|---|---|---|
| 5,427,327 | A * | 6/1995 | Anderson et al. | 242/362 |
| 6,450,259 | B1 * | 9/2002 | Song et al. | 166/255.1 |
| 7,377,051 | B2 | 5/2008 | Morris et al. | |
| 2004/0024418 | A1 * | 2/2004 | Irion et al. | 606/205 |
| 2009/0285051 | A1 * | 11/2009 | Poitzsch et al. | 367/19 |
| 2012/0046799 | A1 * | 2/2012 | Alex et al. | 700/298 |

* cited by examiner

*Primary Examiner* — David Andrews
(74) *Attorney, Agent, or Firm* — Haynes and Boone LLP

(57) ABSTRACT

A system for determining a depth in a wellbore of a reference point associated with a coiled tubing. The system comprises a sensor coupled to a coiled tubing spool, wherein the sensor coupled to the coiled tubing spool is configured to determine an angular position of the spool, a processor coupled to the sensor, a memory coupled to the processor, and an application stored in the memory that, when executed by the processor, determines the depth in the wellbore of the reference point of the coiled tubing based on an input from the sensor coupled to the coiled tubing spool.

18 Claims, 5 Drawing Sheets

SYSTEM AND METHOD OF COILED TUBING DEPTH DETERMINATION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Coiled tubing may be used to perform a variety of wellbore service operations including drilling, setting casing, setting packers, perforation, and other operations. As is known to those skilled in the art, coiled tubing is relatively flexible continuous tubing that can be run into the wellbore from a large spool mounted on a truck or other support structure. While a rig must stop periodically to make up or break down connections when running drilling pipe into or out of the wellbore, coiled tubing can be run in for substantial lengths before stopping to join in another strand of coiled tubing, thereby saving time with reference to jointed pipe. The coiled tubing is typically run into and pulled out of the wellbore using a device referred to as an injector. As the injector feeds coiled tubing into the wellbore, coiled tubing is unrolled or paid out from the coiled tubing spool. As the injector withdraws coiled tubing out of the wellbore, coiled tubing is rolled onto or taken up by the coiled tubing spool.

SUMMARY

In an embodiment, a system for determining a depth in a wellbore of a reference point associated with a coiled tubing is disclosed. The system comprises a sensor coupled to a coiled tubing spool, wherein the sensor coupled to the coiled tubing spool is configured to determine an angular position of the spool, a processor coupled to the sensor, a memory coupled to the processor, and an application stored in the memory that, when executed by the processor, determines the depth in the wellbore of the reference point of the coiled tubing based on an input from the sensor coupled to the coiled tubing spool.

In an embodiment, a method of determining a depth in a wellbore of a reference point associated with a coiled tubing is disclosed. The method comprises establishing an initial reference for an angular position of a coiled tubing spool, receiving an input sensed angular position of the coiled tubing spool, and determining the depth of the reference point of the coiled tubing in the wellbore based on the initial reference and based on the input sensed angular position of the coiled tubing spool.

In an embodiment, a method of running coiled tubing into a wellbore is disclosed. The method comprises driving the coiled tubing in one of a downhole or uphole direction in the wellbore, determining a first estimate of a velocity of the coiled tubing based on an input received from a contact sensor contacting the coiled tubing, determining an angular velocity of a coiled tubing spool based on an input received from an angular position sensor coupled to the coiled tubing spool, and correlating the first estimate of the velocity of the coiled tubing with the angular velocity of the coiled tubing spool.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Figure 1:
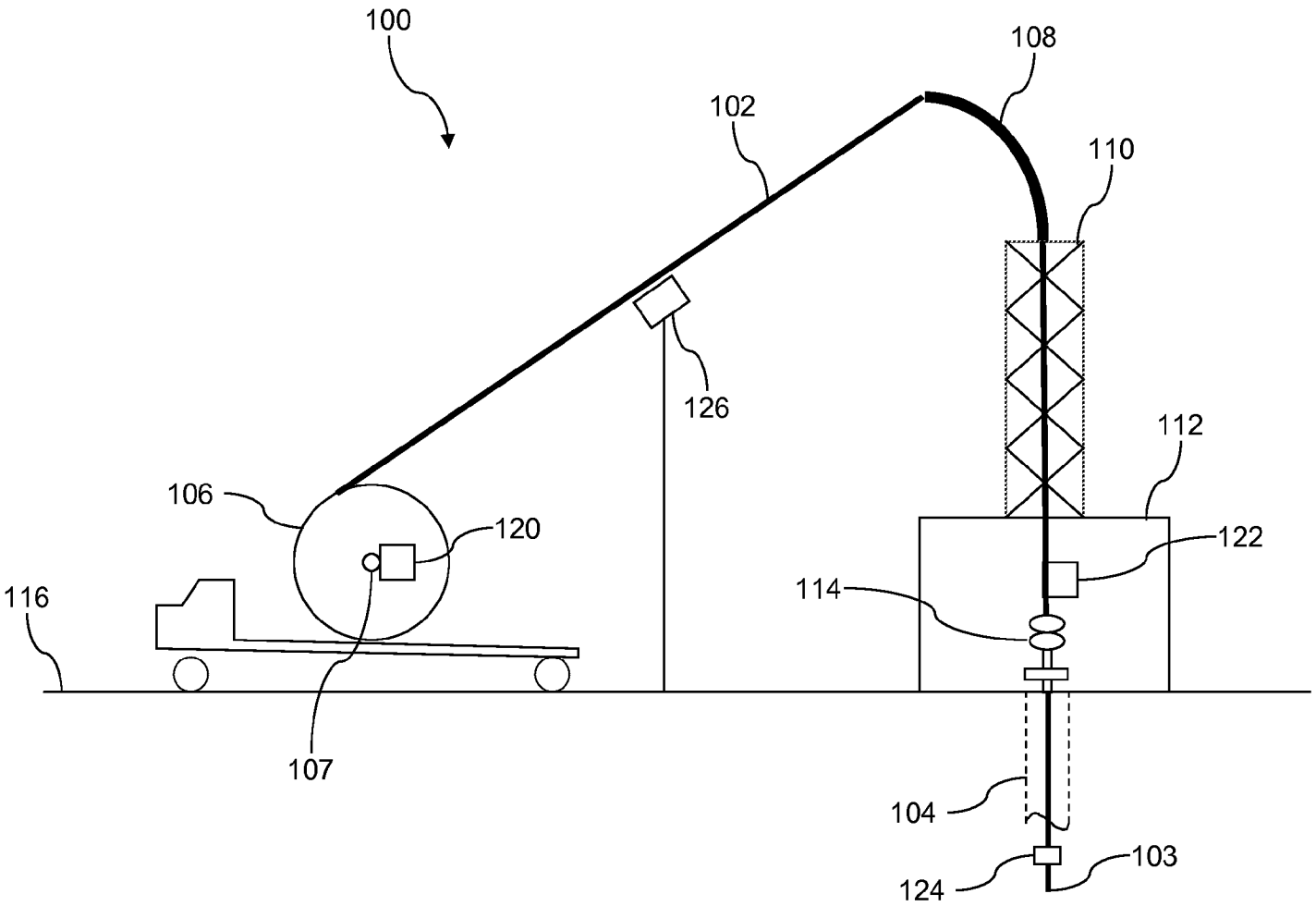
FIG. 1 is an illustration of a wellbore servicing system according to an embodiment of the disclosure.

Turning now to FIG. 1, a wellbore servicing system 100 is described. In an embodiment, the system 100 comprises coiled tubing 102 having an end 103 deployed into a wellbore 104. The coiled tubing 102 may be provided from a coiled tubing spool 106 having an axle 107, where the coiled tubing spool 106 pays out the coiled tubing 102 when the end 103 is driven into the wellbore 104 and that takes up the coiled tubing 102 when the end is pulled out from the wellbore 104.

The coiled tubing 102 may be moved into and out of the wellbore 104 with an injector. The coiled tubing 102 may be supported by a gooseneck 108 coupled to a mast 110 or other supporting structure. The mast 110 or other support structure may be supported by a substructure 112. The coiled tubing 102 may be stabbed into and fed through a blowout preventer (BOP) stack 114 or a completion christmas tree. The coiled tubing spool 106 may be referred to as the spool 106.

In an embodiment, the system 100 comprises an angular position sensor 120 that is coupled to the coiled tubing spool 106. In another embodiment, however, a different sensor may be coupled to the coiled tubing spool 106, for example an angular velocity sensor, a rotational counter, a weight sensor, or combinations of different kinds of sensors. An angular position or an increment of angular position value may be developed by the angular position sensor 120, or the outputs of the angular position sensor 120 may be analyzed by another device, for example a coiled tubing depth computer 152 discussed with reference to FIG. 2 below, to determine an angular position value.

The angular position value may represent the amount of rotation of a point of reference on the spool 106 and/or the axle 107 with respect to an origin point. The angular position value may be represented in any units, for example degrees, radians, or some other unit of angular position. The angular position may vary from 0 degrees to about equal to or greater than 360 degrees. Alternatively, the angular position may vary from 0 degrees to just less than 360 degrees or from 0 radians to just less than $2\pi$ radians ($\pi$ is an irrational number approximated by 3.141592654, or some other suitable well known approximation). Alternatively, the angular position value may vary from 0 degrees to just more than −360 degrees. Alternatively, the angular position value may vary from 0 degrees to just more than $-2\pi$ radians. Alternatively, the angular position value may vary from just more than −360 degrees to just less than +360 degrees or from just more than $-2\pi$ radians to just less than $+2\pi$ radians. The direction of rotation that is associated with a positive angular position and the direction of rotation that is associated with a negative angular position may be selected by one skilled in the art: the teachings of the present disclosure can be readily adapted to either design choice.

An angular displacement value may be developed from accumulating changes in angular position from a predefined starting point or reference point by the angular position sensor 120, by the coiled tubing depth computer 152, or by another device. For example, if the angular position value rotates in a positive sense and passes 360 degrees by 90 degrees, the angular position value may roll over to 0 degrees and then be determined to be 90 degrees. The angular displacement that corresponds to this rotation would be 360 degrees plus 90 degrees or 450 degrees. If the angular position rolls over four times—completes four rotations—and then continues on to the 90 degree angular position, the corresponding angular displacement that corresponds to this rotation would be 1530 degrees. In an embodiment, the angular sensor 120 may itself produce an output that accumulates angular position changes and hence represents angular displacement, for example a rotary encoder type of angular sensor 120 (these may often be used with servomotors). In an embodiment, either an incremental rotary encoder or an absolute encoder may be employed. An absolute encoder may output an indication of the rotary position. An incremental encoder may output an indication of the rotary motion that may be converted into a rotary position, for example by summing or other processing to determine or update the rotary position. If the angular position moves backwards, for example moves from 90 degrees to 45 degrees, the angular displacement is correspondingly decremented by 45 degrees. If the angular position moves backwards by two complete rotations, the angular displacement is correspondingly decremented by 720 degrees. In combination with the teachings of the present application, one skilled in the art will appreciate how these exemplary cases could be represented in alternative rotational units. In an embodiment, the angular displacement values may be constrained to non-negative values. In another embodiment, however, the angular displacement values may be constrained to non-positive values. In another embodiment, the angular displacement may range across positive, zero, and negative values.

An angular velocity may be developed from the angular position value and/or the angular displacement value, by the angular position sensor 120, by the coiled tubing depth computer 152, or by another device. By determining a change of angular position and/or a change of angular displacement between a first time and a second time, the angular velocity may be determined as the change in angular position divided by the change in time between the first time and the second time. A smoothed or window averaged angular velocity may be developed that averages the values of the most recent angular velocity values, for example the last five angular velocity values, the last ten angular velocity values, or some other number of recent angular velocity values.

The sensor coupled to the coiled tubing spool 106, for example the angular position sensor 120, provides an indication about the paying out and the taking up of the coiled tubing 102 that may be used for a variety of monitoring and/or control purposes, as described in more detail hereinafter. While the description below refers to the angular position sensor 120, the present disclosure contemplates selecting and/or using other sensors to develop the indication of paying out from the spool 106 and taking up by the spool 106 of the coiled tubing 102 to balance design constraints, for example costs, accuracy, reliability, availability of different kinds of sensors.

In an embodiment, the coiled tubing spool 106 is supported on an axle 107 or shaft that is coupled to and rotates with the spool 106. The coiled tubing spool 106 and the axle 107 rotate about a common axis. The coiled tubing spool 106, the axle 107, shaft, or combinations may be provided with calibration marks, for example, equal intervals of alternating indications, such as black stripe and white stripe. The angular position sensor 120 may incorporate an optical scanner that detects the calibration marks and develops an indication or an estimate of angular displacement based on the known angular distance between the calibration marks. In an embodiment, the coiled tubing spool 106 is coupled to the angular position sensor 120 by one or more gears such that multiple rotations of the coiled tubing spool 106 causes less than a full rotation of a shaft of the angular position sensor 120. Alternatively, in an embodiment, the coiled tubing spool 106 is coupled to the angular position sensor 120 by one or more gears such that one rotation of the coiled tubing spool 106 causes multiple rotations of the shaft of the angular position sensor 120. In an embodiment, the angular position sensor 120 is incorporated into a servomotor, wherein a shaft of the servomotor is coupled to an armature of the servomotor, and wherein the shaft is coupled to the coiled tubing spool 106. The combination of the servomotor with other apparatus, for example, in an embodiment, a feedback mechanism, may be used to determine an angular displacement of the motor armature over a range of travel of less than 360 degrees or over multiple revolutions. Additionally, when used in this way, the combination of the servomotor with a feedback mechanism may be configured such that it is able to determine its angular position even through or across power outages. In combination with the present disclosure, one skilled in the art will appreciate that the structure for determining angular displacement and/or angular position may be adapted in various ways to accommodate specific implementation of the system 100 and/or the spool 106. Additionally, other angular position and/or angular displacement sensors may be employed in place of the angular position sensor 120.

Alternatively, the spool 106 and/or axle 107 may be provided with protuberances, cogs, detents, or other surface irregularities that may be distinguished by the angular position sensor 120 to determine an angular position or an incremental change in angular position of the spool 106. For example, if the spool 106 is provided with 60 equally spaced detents, a spring biased probe of the angular position sensor 120 may be able to detect angular position with about 6 degrees of resolution or perhaps better resolution.

In an embodiment, the system 100 comprises a contact sensor 122 that contacts the coiled tubing 102 to sense motion of the coiled tubing 102. For example, in an embodiment, the contact sensor 122 comprises a roller in contact with the coiled tubing 102 that rotates in one angular direction as the coiled tubing 102 is run into the wellbore 104 and rotates in the opposite angular direction as the coiled tubing 102 is withdrawn from the wellbore 104. The contact sensor 122 develops a depth count or depth value. The roller component of the contact sensor 122, however, may slip or otherwise be prone to error when contacting the coiled tubing 102, especially because the coiled tubing 102 may be coated with lubricant and/or drilling fluid when it passes under the roller component.

In an embodiment, the system 100 comprises a collar locator 124, for example as part of a tool string coupled to or adjacent the end 103 of the coiled tubing 102. The collar locator 124 may detect casing collars as the coiled tubing 102 moves in the wellbore 104. As is known to those skilled in the art, wellbores 104 may be cased with a string of pipe joints (e.g., casing) coupled to each other, and the ends of the pipe joints may be referred to as collars. As the coiled tubing 102 and the collar locator 124 move in the wellbore 104, the collar locator 124 approaches and passes beyond casing collars. The collar locator 124 may provide a signal that indicates when a collar is proximate to the collar locator 124. The collar locator 124 may be coupled to the surface by a communication link provided by one or more electrical wires or optical fibers. The use of electrical wire or optical fibers for may provide advantages of real-time or near real-time access to the collar location information.

In an embodiment, the system 100 comprises a sag detector 126. The sag detector 126 provides an indication of the sag in the coiled tubing 102 between the coiled tubing spool 106 and the goose neck 108. The amount of sag in the coiled tubing 102 may be analyzed to estimate an amount of stretch in the coiled tubing 102, for example as a result of the weight of the string of coiled tubing 102 in the wellbore 104. The sag detector 126 may be supported proximate to the coiled tubing 102, for example supported by a pole or by a mast structure, and may feature an optical detection mechanism, a magnetic detection mechanism, or other mechanism. For example, a laser beam may be projected along a line of sight from a point proximate to where the coiled tubing 102 contacts the windings of coiled tubing on the spool 106 to a point proximate to where the coiled tubing 102 contacts the gooseneck 108. The sag detector 126 may sense or determine a greatest distance (a maximum sag amount) between the laser beam and the coiled tubing 102, for example using a digital image processing algorithm and/or using a second laser beam that deflects under control to find the maximum sag point. Other sag detector 126 apparatus are contemplated by the present disclosure. In an embodiment, a roller on a lever contacts the coiled tubing 102 between the gooseneck 108 and the spool 106, the lever pivots around a center as a function of droop in the coiled tubing 102, and the changing angle of the lever is output as an indication of the sag of the coiled tubing 102. In an embodiment, a camera could use image analysis to determine the sag of the coiled tubing 102, for example a camera supported by a pole.

It is understood that while several devices 120, 122, 124, 126 are described above, in different embodiments one of more of the devices 120, 122, 124, 126 may be used in the system 100. Alternatively, in an embodiment, a combination of all of the devices 120, 122, 124, 126 may be used in the system 100.

Figure 2:
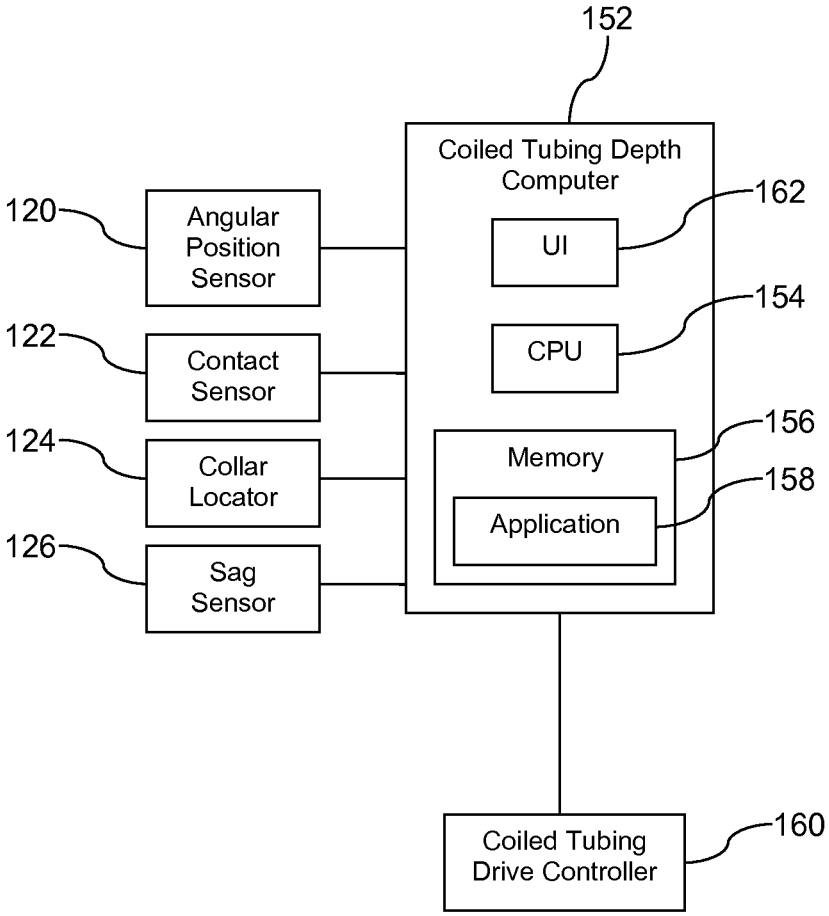
FIG. 2 is an illustration of a coiled tubing depth computation system according to an embodiment of the disclosure.

Turning now to FIG. 2, a coiled tubing depth computer 152 is described. In an embodiment, the depth computer 152 comprises a central processing unit (CPU) 154, a memory 156, and an application 158. The depth computer 152 receives inputs from one or more of the angular position sensor 120, the contact sensor 122, the collar locator 124, and the sag sensor 126. The inputs may be provided in any form to the depth computer 152. For example, one or more of the inputs may be unfiltered analog signals output by the devices 120, 122, 124, 126. One or more of the inputs may be filtered analog signals output by the devices 120, 122, 124, 126. One or more of the inputs may be digital values transmitted periodically or aperiodically over a serial line or over parallel lines to the depth computer 152.

The application 158 calculates or determines a depth of a reference point of the coiled tubing 102, for example the end 103, based on the input or inputs from the one or more devices 120, 122, 124, 126. Alternatively, the application 158 calculates a depth in the wellbore 104 of a downhole tool coupled to the coiled tubing string 102. In an embodiment, the end 103 of the coiled tubing 102 is stabbed into one of the blowout preventer stack 114 or the production Christmas tree. The coiled tubing 102 may be run in a predefined distance that places the end 103 flush with the surface 116, for example a predefined distance corresponding to the height of the blowout preventer stack 114 or the production Christmas tree above the surface 116. With the end 103 of the coiled tubing 102 in this position, the depth computer 152 may assign the input value from the angular position sensor 120 as an initial coiled tubing spool angular location reference. Likewise, the depth computer 152 may assign the input value from the contact sensor 122 as an initial coiled tubing contact sensor location reference. In an embodiment, the depth computer 152 may transmit a signal to the contact sensor 122 to establish a zero depth reference.

After determination of initial references and/or after initial calibration of sensors at the zero depth point or other known depth point, the coiled tubing 102 may be run into the wellbore 104, driven by the coiled tubing injector. As the injector drives the coiled tubing 102 into the wellbore 104, the coiled tubing spool 106 rotates to pay out the coiled tubing 102. For example, if the coiled tubing 102 is driven an additional 10 feet into the wellbore 104 by the injector, the spool 106 rotates to pay out about 10 feet of coiled tubing 102. By keeping track of the angular displacement of the spool 106 relative to the initial reference, the application 158 may calculate the length of coiled tubing 102 that is run into the wellbore 104. As an example, in combination with the teachings of the present disclosure, one skilled in the art would be able to define a formula that defines the length of coiled tubing 102 that is run into the wellbore 104 based on integrating or summing the angular position or the angular displacement of the coiled tubing spool 106, for example differentiating a differential of the angular position or a differential of the angular displacement. In an embodiment, the integration or summation of differentials may be multiplied by an appropriately determined constant, for example a constant that is determined based on a diameter of an outer wind of coiled tubing 102 on the spool 106.

As another example, if the outer wind of the coiled tubing 102 on the spool 106 is about 14 feet in diameter, the circumference of the outer wind of coiled tubing 102 on the spool 106 can be calculated according to well known geometrical equations to be about 44 feet. For example, the circumference of a circle may be calculated as diameter×π, where π (greek letter pi) is an irrational number that may be approximated by 3.141592654 or by some other suitable approximation of π having either a fewer number of digits or a greater number of digits, that may be looked up in standard mathematical references. Alternatively, the circumference of a circle may be calculated as 2×radius×π. An angular displacement of 360 degrees, hence, may be associated to increasing the depth of the end 103 of the coiled tubing 102 in the wellbore 104 by about 44 feet, an angular displacement of 90 degrees may be associated to a depth increase of about 11 feet, an angular displacement of 10 degrees may be associated to a depth increase of about 1.22 feet, and so forth. As an example, if the depth of the end 103 of the coiled tubing 102 in the wellbore 104 was 4723 feet and the spool 106 rotates 10 degrees in a first sense associated with paying out coiled tubing 102, the depth of the end 103 of the coiled tubing 102 in the wellbore 104 may be calculated to then be 4723+1.22 feet or 4724.22 feet. Alternatively, if the spool 106 rotates 10 degrees in a second sense associated with taking up coiled tubing 102, the depth of the end of the coiled tubing 102 in the wellbore 104 may be calculated to then be 4723−1.22 feet or 4721.78 feet.

In an embodiment, a radius or a diameter of the outer wind of coiled tubing 102 on the spool 106 may be determined by a winding sensor, and the winding sensor may provide an indication of the radius or diameter input to the depth computer 152. Alternatively, an initial radius or diameter of the outer wind of the coiled tubing 102 on the spool 106 may be configured into the application 158 and/or stored in the memory 156, and the application 158 may determine the radius or diameter of the outer wind of the coiled tubing 102 on the spool 106 based on a known cross-sectional diameter or radius of the coiled tubing 102, based on a number of winds of coiled tubing 102 on one width of the spool 106, and based on the angular displacement input from the angular position sensor 120.

As an example, if the width of the spool 106 accommodates 6 widths of the coiled tubing 102, the coiled tubing is about 3 inches in diameter, the initial outer wind diameter of the coiled tubing 102 on the spool 106 is 14 feet, and if the aggregate angular displacement is 6×360 degrees=2160 degrees, the first layer of coiled tubing 102 can be supposed to have been paid out from the spool 106 and the second layer of the coiled tubing 102 now forms the outer wind of the coiled tubing 102 on the spool 106. Since the coiled tubing is about 3 inches in diameter, removing the first wind layer from the spool 106 reduces the diameter by 6 inches, and the outer wind diameter of the coiled tubing 102 on the spool 106 is about 13.5 feet.

Alternatively, rather than calculating, the diameter of the outer wind of the coiled tubing 102 on the spool 106 may be looked up in a predefined table or other data list in the memory 156 or the application 158. For example, the angular displacement of the spool 106 in the range 0 to 2160 degrees may be defined in a data table to associate to a diameter of the outer wind of the coiled tubing 102 on the spool 106 of 14 feet; the angular displacement 2160.0001 to 4320 degrees may be defined to associate to a diameter of 13.5 feet; the angular displacement 4320.0001 to 6480 degrees may be defined to associate to a diameter of 13 feet, etc. Alternatively, the diameter of the outer wind of the coiled tubing 102 on the spool 106 may be defined or approximated as a function of the angular displacement of the spool 106.

Alternatively, rather than calculating the depth of the end 103 of coiled tubing 102 in the wellbore 104 based on calculations of circumference and angular displacement as described above, the application 158 may determine the depth of the end 103 of coiled tubing 102 in the wellbore 104 by looking up the depth in a data table or list using the angular displacement. For example, a table may map an angular displacement of 2160 degrees to a depth of 264 feet, an angular displacement of 4320 degrees to a depth of 518.5 feet, and so on. The application 158 may determine depths for angular displacements that fall between defined mappings in the data table or list by interpolating between the two nearest angular displacements that are associated with defined mappings, for example using linear interpolation or other interpolation techniques. It is understood that such a table of mappings may comprise any number of defined mappings.

In an embodiment, the application 158 may occasionally adjust the calculation of the depth of the end 103 of coiled tubing 102 in the wellbore 104 in response to inputs other than the input from the angular position sensor 120. For example, when an input from the collar locator 124 indicates that a collar is detected, the application 158 may determine a depth associated with the subject collar location and assign the determined value to the calculated depth value. This may be considered to be re-referencing the application 158. The application 158 or the memory 156 may store a table of collars mapped to depths. This table may be defined based on casing strapping data or casing logging data or other data. Thus, the first collar may be defined to associate to a depth of 32.73 feet, the second collar may be defined to associate to a depth of 64.3 feet, etc. By re-referencing the application 158 in this way, based on inputs from the collar locator 124, incremental and/or accumulative errors in calculating the depth of the end 103 of the coiled tubing 102 in the wellbore 104 based on the input from the angular position sensor 120 may be limited and/or reduced. In an embodiment, the reassigned value of the depth may be stored in the tables or lists associating depth to angular displacements described above.

In an embodiment, the application 158 may compare the value of depth it has calculated to the depth calculated or sensed by the contact sensor 122. The application 158 may determine a slippage amount of the coiled tubing 102 in contact with the roller component of the contact sensor 122 based on the comparison. In an embodiment, the application 158 may correlate the value of depth calculated based on the input from the angular position sensor 120 to the value of depth input by the contact sensor 122. When the values do not correlate, the application 158 may determine that an anomalous or unsafe condition exists and may transmit an alert or alarm signal to a coiled tubing drive controller 160. When comparing the values, the application 158 may determine that the values correlate if they are within a predefined tolerance and/or predefined threshold of agreement and/or variance, for example within 1 inch of depth of each other, within 6 inches of depth of each other, within 2 feet of depth of each other, within 6 feet of depth of each other, or some other threshold of depth. The application 158 may determine the values correlate if the velocity of the coiled tubing calculated based on the input from the angular position sensor 120 is within a predetermined threshold of the velocity of the coiled tubing calculated based on the input from the contact sensor 122, for example within 6 inches per second of each other, within 1 foot per second of each other, within 2 feet per second of each other, or some other threshold of velocity.

The application 158 may determine the values correlate based on a percentage of different between the values, for example a different of at least 1 percent, a difference of at least 2 percent, a difference of at least 5 percent, a difference of at least 10 percent, or another percentage. In an embodiment, the percentage may be relative to about the total depth of the coiled tubing 102 in the wellbore 103. In another embodiment, the percentage may be relative to about the change in depth since the previous re-calibration or re-referencing of the depth, for example since the previous re-calibration based on sensing a collar having a known depth.

For example, if the contact sensor 122 indicates increasing depth while the application 158 determines that the input from the angular position sensor 120 indicates no rotation of the spool 106, the spool 106 may be locked in position, and damage to the system 100 and/or injury to personal may occur if the injector continues to drive coiled tubing 102 into the wellbore 104, for example, the goose neck 108 and/or the mast 110 may be pulled over. Alternatively, if the correlation indicates that coiled tubing 102 is being paid out from the spool 106 at a rate faster than the injector is driving the coiled tubing 102 into the wellbore 104, the spool 106 may be malfunctioning and undesirably unwinding coiled tubing 102 from the spool 106 too rapidly. In an embodiment, the application 158 provides a periodically updating correlation signal to the coiled tubing drive controller 160, and the coiled tubing drive controller 160 controls the injector system based at least in part on this correlation signal.

In an embodiment, the application 158 may determine a stretch of the coiled tubing 102 based in part on an input from the sag sensor 126. Alternatively, or in addition, the application 158 may use an input from the sag sensor 126 in combination with the correlation described above to provide an alert or other input to the coiled tubing drive controller 160. In an embodiment, the application 158 may use inputs from one or more of the sensors 120, 122, 124, 126 to determine the state, position, depth, or velocity of the coiled tubing 102 and/or downhole tools coupled to the coiled tubing 102. The application 158 may also use inputs from one or more of the sensors 120, 122, 124, 126 for other purposes. For example, the application 158 may determine an angular velocity of the spool 106 by associating an indication of a first angular position received from the angular position sensor 120 with a first time, associating an indication of a second angular position received from the angular position sensor 120 with a second time, and determining the angular velocity as the change in angular position between the first angular position and the second position divided by the time interval between the first time and the second time. Likewise, the application 158 can determine a velocity of the coiled tubing 102 by associating a calculated first depth of the coiled tubing 102 with a first time, associating a calculated second depth of the coiled tubing 102 with a second time, and determining the velocity of the coiled tubing 102 as the change in depth between the first depth and the second depth divided by the time interval between the first time and the second time. The velocity of the coiled tubing 102 may be determined based on inputs from one or more of the sensors 120, 122, 126, 128.

In an embodiment, the coiled tubing depth computer 152 may further comprise a user interface 162. The user interface 162 may comprise a presentation device such as a display screen. The user interface 162 may provide an input device such as a keyboard or touch screen to provide inputs, to select display outputs, and to invoke functions of the coiled tubing depth computer 152 and/or the coiled tubing drive controller 160. In an embodiment, the coiled tubing depth computer 152 may be part of and/or integrated with an automated control system.

The user interface 162 may be used to trigger the application 158 and/or one or more of the sensors 120, 122, 124, 126 (e.g., the contact sensor 122) to establish a zero depth reference. The user interface 162 may be used to select an alternative to the end 103 of the coiled tubing 102 whose depth in the wellbore 104 is determined or displayed, for example locations of one or more tools or components conveyed into the wellbore 104 by the coiled tubing 102. In an embodiment, a user may be able to select display of the depth of a first perforation gun in the wellbore 104 and later select display of the depth of a second perforation gun in the wellbore 104. The application 158 and/or the memory 156 may be configured with a model of a bottom hole assembly (BHA) coupled to the end 103 of the coiled tubing 102 that designates the location of components of the bottom hole assembly as offsets from the end 103 of the coiled tubing 102. The application 158 may determine the depth of the end 103 of the coiled tubing 102 in the wellbore 104 but be operable to provide depth of selected components, for example the first perforation gun, by adding or subtracting an offset distance to the depth of the end 103 of the coiled tubing 102.

In an embodiment, when a collar located signal is input to the depth computer 152, thereby promoting the application 158 precisely determining the depth of the end 103 of the coiled tubing 102 in the wellbore 104 (because the depth of a given collar may be known precisely from existing wellbore data such as logging data), the direction of motion of the coiled tubing 102 may be reversed to determine one of a compression of the coiled tubing 102 or a stretch of the coiled tubing 102. For example, suppose the coiled tubing 102 is being run into the wellbore 104 by the injector. A collar located signal is received from the collar locator 126 by the depth computer 152. The application 158 determines that based on the specific located collar, the depth of the end 103 of the coiled tubing 102 in the wellbore is 8753.7 feet. The depth associated with the sensed angular position of the spool 106 is re-referenced or recalibrated. Further, suppose the next collar up hole is located at 8721.83 feet. When the coiled tubing 102 is pulled up in the wellbore 104 until a collar located signal is received from the collar locator 126, when it is proximate to the next collar up hole, the depth determined by the application 158 based on the change in the sensed angular position of the spool 106 is 8700.0 feet. The discrepancy between this depth calculated based on the sensed angular position of the spool 106 and the known location of the next collar up hole can be attributed to a compression and/or stretch of the coiled tubing 102. The compression and/or stretch of the coiled tubing 102 determined at different depths in this way may be used to correct depth calculations.

Figure 3:
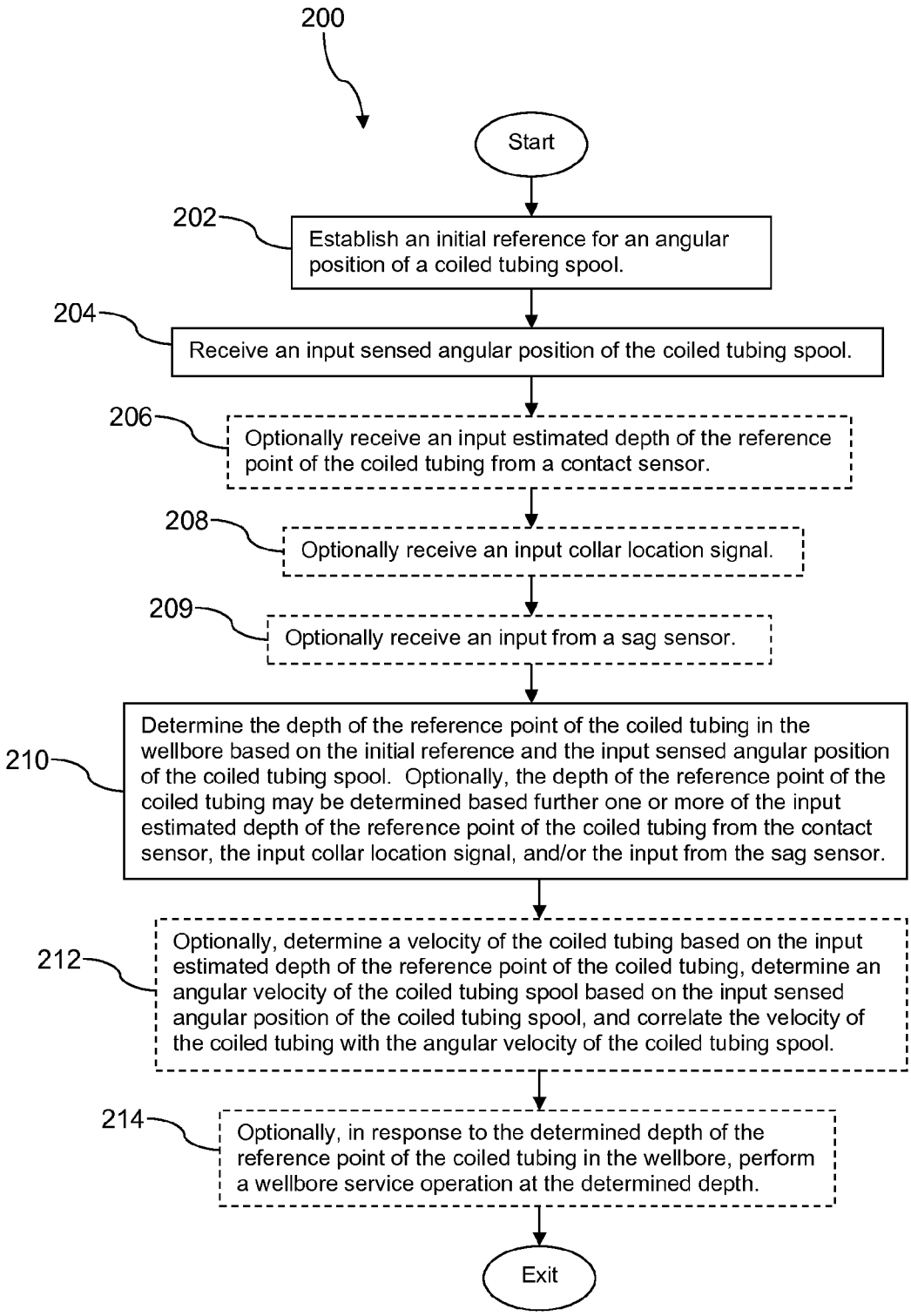
FIG. 3 is a flow chart of a method according to an embodiment of the disclosure.

Turning now to FIG. 3, a method 200 is described. At block 202, an initial reference for an angular position of the coiled tubing spool 106 is established. For example, the application 158 is signaled to associate the current value input by the angular position sensor 120 as matching a zero depth of the end 103 of the coiled tubing 102 in the wellbore 104. Alternatively, the application 158 is signaled to associate the current value input by the angular position sensor 120 as matching some other calibrated depth of the end 103 of the coiled tubing 102 in the wellbore 104, for example a first collar location depth in the wellbore 104, for example, a depth of 33.73 feet. Alternatively, rather than associating the depth reference based on the position of the end 103 of the coiled tubing 102 in the wellbore 104, the depth reference may be associated to any portion of a tool string coupled to the coiled tubing 102, for example the collar locator 124, a perforation gun, a packer, a cross-over gravel packing tool, a completion tool, a casing cutter, a casing mill, a whipstock, a hydrojetting tool, or other downhole tool or other device.

At block 204, an input sensed angular position of the coiled tubing spool is received. For example, an input from the angular position sensor 120 is received. The input may be in any of a variety of forms. The input may be an analog value, for example an analog voltage, or a digital value, for example an 8 bit digital value, a 16 bit digital value, a 32 bit digital value, or some other digital value. The input may be filtered or unfiltered. In an embodiment, the angular position sensor 120 may filter the indication of angular position before outputting to the coiled tubing depth computer 152. Alternatively, the angular position sensor 120 may output an unfiltered indication to the coiled tubing depth computer 152.

At block 206, an input of an estimated depth of the end 103 of the coiled tubing 102 in the wellbore 104 is optionally received from the contact sensor 122. In an embodiment of the system 100 that does not comprise the contact sensor 122, block 206 is not performed. At block 208, an input of a collar location signal is optionally received from the collar locator 124. In an embodiment of the system 100 that does not comprise the collar locator 124, block 208 is not performed. At block 209, an indication of sag in the coiled tubing 102 between the gooseneck 108 and the spool 106 is optionally received from the sag sensor 126.

At block 210, the depth of the end 103 of the coiled tubing 102 in the wellbore 104 is determined based on the initial reference and based on the input sensed angular position of the spool 106. The coiled tubing depth computer 152 and/or the application 158 may filter the input from the angular position sensor 120 if the angular position sensor 120 does not perform such filtering. The depth may be determined in a variety of manners, as described in more detail above. Optionally, the depth of the end 103 of the coiled tubing 102 in the wellbore 104 may be determined based further on at least one of the input estimated depth of the end 103 of the coiled tubing 102 in the wellbore 104 provided by the contact sensor 122, the input collar location signal provided by the collar locator 124, and/or the input from the sag sensor 126. Alternatively, rather than determining the depth of the end 103 of the coiled tubing 102 in the wellbore 104, the depth in the wellbore 104 of any portion of a tool string coupled to the coiled tubing 102, for example the collar locator 124, a perforation gun, a packer, a whipstock, or other downhole tool or other device, may be found.

At block 212, optionally, a velocity of the coiled tubing 102 is determined based on the estimated depth of the end 103 of the coiled tubing 102 in the wellbore 104 input by the contact sensor 122, an angular velocity of the coiled tubing spool 106 is determined based on the input sensed angular position of the coiled tubing spool 106 input by the angular position sensor 120, and the estimated velocity of the coiled tubing 102 is correlated with the angular velocity of the coiled tubing spool 106.

A variety of kinds of correlations may be performed. The angular velocity of the coiled tubing spool 106 may be converted to a velocity of the coiled tubing 102 at the spool 106, and this velocity of the coiled tubing 102 at the spool 106 may be compared with the estimated velocity of the coiled tubing 102 input by the contact sensor 122. When the difference between these velocities is small, the difference may be attributed to slippage error in the contact sensor 122, and this difference may be used to calculate a slippage of the contact sensor 122. If the difference is bigger, however, the spool 106 and the injector may be out of synchronization, and the coiled tubing depth computer 152 may transmit an alert or alarm to the coiled tubing drive controller 160. Alternatively, the application 158 may compare the angular velocity of the coiled tubing spool 106 to the estimated velocity of the coiled tubing 102 provided by the contact sensor 122 directly, without converting to a velocity of coiled tubing 102 at the spool 106. In an embodiment, rather than correlating velocities, the depth determined by the contact sensor 122 and the depth determined based on the input from the angular positions sensor 120 may be correlated, and if the resultant correlation does not meet a predefined threshold or standard of correlation, the coiled tubing depth computer 152 may transmit an alert or alarm to the coiled tubing drive controller 160.

In response to the determination of the depth of the reference point of the coiled tubing 102 in the wellbore 104, at block 214, a wellbore service operation is optionally performed at the determined depth. The wellbore service operation may at least one of a perforation operation, a cementing operation, a packer setting operation, a gravel packing operation, a fracturing operation, a casing wall cutting operation, a whipstock setting operation, a completion tool setting operation. Alternatively, the wellbore service operation may be other downhole operations.

Figure 4:
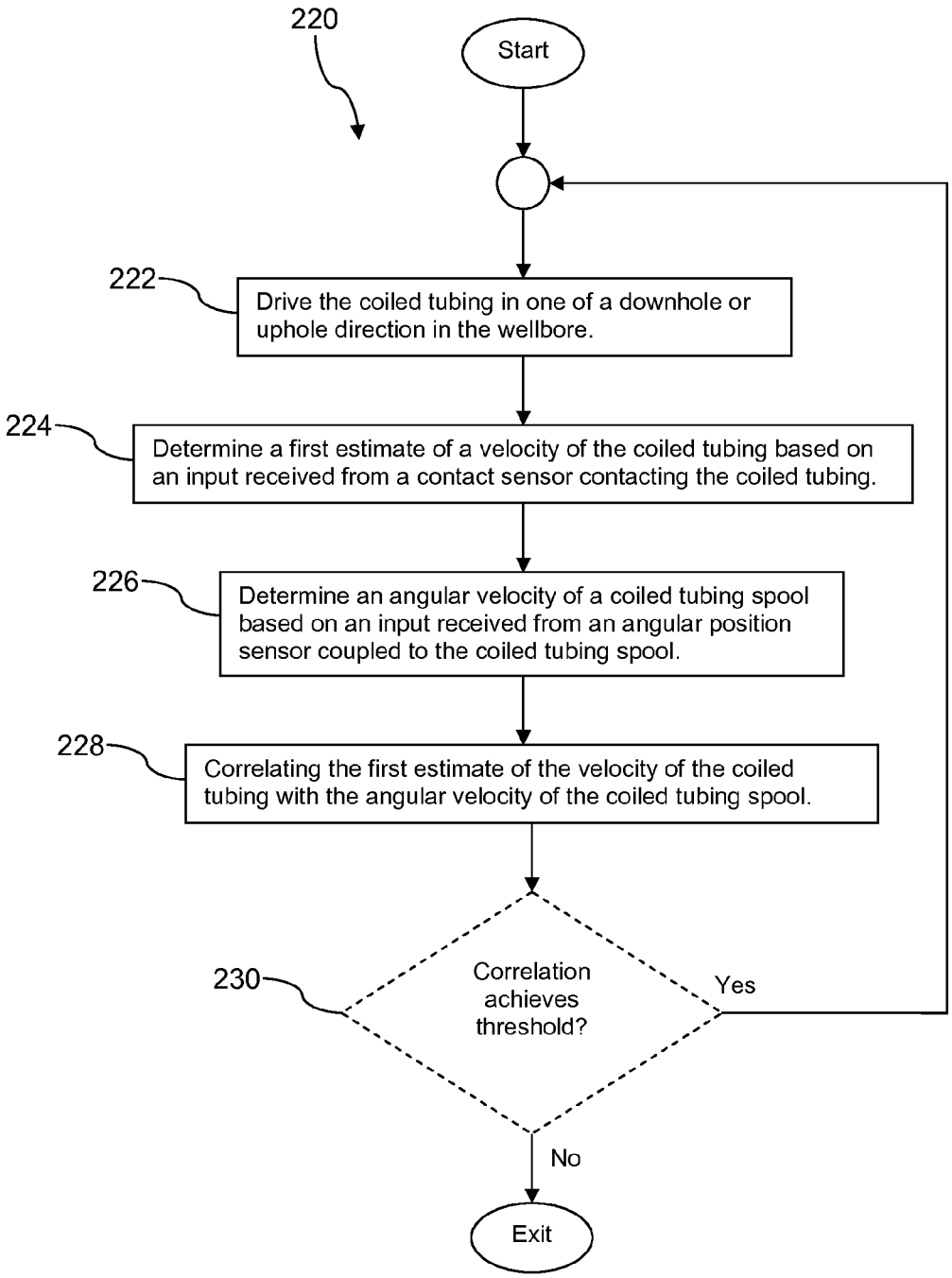
FIG. 4 is a flow chart of another method according to an embodiment of the disclosure.

Turning now to FIG. 4, a method 220 is described. At block 222, the coiled tubing 102 is driven in the wellbore 104 either in a downhole or in an uphole direction. At block 224, a first estimate of the depth and/or velocity of the coiled tubing 102 is determined based on input from the contact sensor 122, where the contact sensor 122 is contacting the coiled tubing 102. At block 226, an angular velocity of the coiled tubing spool 106, a velocity of the coiled tubing 102 calculated based on the angular displacement of the spool 106, and/or a depth calculated based on the angular displacement of the spool 106 is determined based on an input received from the angular position sensor 120, where the angular position sensor 120 is coupled to the coiled tubing spool 106.

At block 228, the first estimate of velocity and/or depth of the coiled tubing 102 is correlated with the angular velocity of the coiled tubing spool 106, the velocity of the coiled tubing 102 determined based on the angular displacement of the spool 106, and/or the depth of the coiled tubing 102 determined based on the angular displacement of the spool 106. At block 230, if the correlation meets a predefined correlation threshold, the processing returns to block 222. If the correlation does not meet the predefined correlation threshold, the processing exits. In an embodiment, when the correlation does not meet the predefined threshold, an alert, an alarm, or other signal is transmitted to the coiled tubing drive controller 160. In an embodiment, when the correlation does not meet the predefined threshold, the coiled tubing drive controller 160 halts the motion of the injector. As described above with reference to FIG. 3, the correlation alternatively may be performed between a first estimate of velocity and/or depth of the end 103 of the coiled tubing 102 in the wellbore 104 determined based on input from the contact sensor 122, and a second estimate of depth and/or velocity of the end 103 of the coiled tubing 102 in the wellbore 104 is determined based on input from the angular position sensor 120.

Coiled tubing may be introduced into an oil or gas well bore through wellhead control equipment to perform various tasks during the exploration, drilling, production, and workover of the well. Coiled tubing may be used, for example, to inject gas or other fluids into the well bore, to inflate or activate bridges and packers, to transport tools downhole such as logging tools, to perform remedial cementing and clean-out operations in the bore, to deliver drilling tools downhole, for electric wireline logging and perforating, drilling, well-bore cleanout, fishing, setting and retrieving tools, for displacing fluids, and for transmitting hydraulic power into the well. The flexible, lightweight nature of coiled tubing makes it particularly useful in deviated well bores.

Coiled tubing generally includes a small diameter cylindrical tubing made of metal or composite that has a relatively thin cross sectional thickness (e.g., from 0.067 to 0.203 inches (1.70-5.16 mm)). The continuous length of coiled tubing is a flexible product made from a steel strip. The strip is progressively formed into a tubular shape and a longitudinal seam weld is made by electric resistance welding (ERW) techniques. The product is typically several thousand feet long and is wound on a reel.

Conventional handling systems for coiled tubing can include a reel assembly, a gooseneck, and a tubing injector head. Reel assemblies may include a rotating reel for storing coiled tubing, a cradle for supporting the reel, a drive motor, and a rotary coupling. When the coiled tubing is introduced into a well bore, the tubing injector head draws the coiled tubing stored on the reel and injects the coiled tubing into a wellhead. The drive motor rotates the reel to pay out the coiled tubing and the gooseneck directs the coil tubing into the injector head. Often, fluids are pumped through the coiled tubing during operations. The rotary coupling provides an interface between the reel assembly and a fluid line from a pump.

Figure 5:
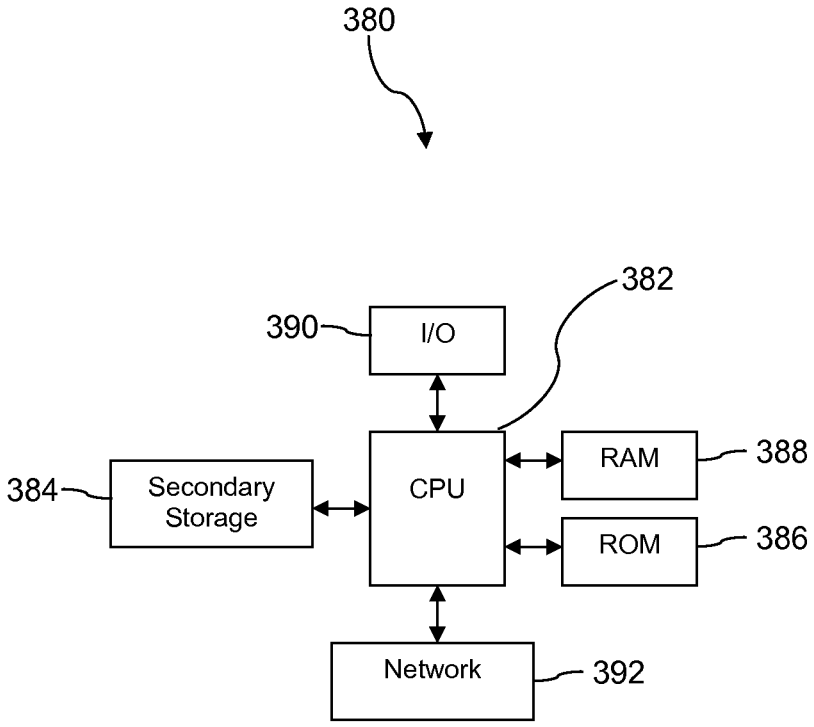
FIG. 5 is an illustration of a computer system according to an embodiment of the disclosure.

FIG. 5 illustrates a computer system 380 suitable for implementing one or more embodiments disclosed herein. For example, the coiled tubing depth computer 152 described with reference to FIG. 2 may be implemented, at least in part, as a computer system. In some contexts the coiled tubing depth computer 152 may be referred to as an embedded computer system or an embedded system, that is a computer system designed for specific control and/or monitoring functions within a larger system. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A system for determining a depth in a wellbore of a reference point associated with a coiled tubing on a coiled tubing spool, the system comprising:

an angular position sensor adapted to be coupled to the coiled tubing spool, wherein the angular position sensor is configured to determine an angular position of the coiled tubing spool;

a winding sensor adapted to be coupled to the coiled tubing spool, wherein the winding sensor is configured to determine a radius and/or a diameter of an outer wind of the coiled tubing on the coiled tubing spool;

a processor adapted to be coupled to the angular position sensor and the winding sensor;

a memory coupled to the processor; and an application stored in the memory that, when executed by the processor, determines the depth in the wellbore of the reference point of the coiled tubing based on respective inputs from the angular position sensor and the winding sensor.

2. The system of claim 1, wherein the angular position sensor comprises one of an incremental rotary encoder or an absolute rotary encoder.

3. The system of claim 1, further comprising a sag sensor that senses a sag of unsupported coiled tubing, wherein the application determines the depth of the reference point of the coiled tubing based further on an input from the sag sensor.

4. The system of claim 1, further comprising a contact sensor that contacts the coiled tubing, wherein the application determines the depth of the reference point of the coiled tubing based further on an input from the contact sensor.

5. The system of claim 1, wherein the processor receives an input from a collar locator coupled to the reference point of the coiled tubing, wherein the application determines the depth of the reference point of the coiled tubing based further on the input from the collar locator.

6. The system of claim 5, wherein the application further determines a stretch amount of the coiled tubing by correlating the respective inputs from the collar locator and the angular position sensor when the coiled tubing is driven downhole with the respective inputs from the collar locator and the angular position sensor when the coiled tubing is pulled uphole.

7. A method of determining a depth in a wellbore of a reference point associated with a coiled tubing on a coiled tubing spool, the method comprising:

establishing an initial reference for an angular position of the coiled tubing spool;

receiving an input sensed angular position of the coiled tubing spool, wherein the input sensed angular position of the coiled tubing spool is determined by an angular position sensor coupled to the coiled tubing spool;

determining an angular velocity of the coiled tubing spool based on the input sensed angular position of the coiled tubing spool;

receiving an input estimated depth of the reference point of the coiled tubing from a contact sensor;

determining a velocity of the coiled tubing based on the input estimated depth of the reference point of the coiled tubing;

receiving an input radius and/or diameter of an outer wind of the coiled tubing on the coiled tubing spool, wherein the input radius and/or diameter of the outer wind of the coiled tubing on the coiled tubing spool is determined by a winding sensor coupled to the coiled tubing spool;

determining the depth of the reference point of the coiled tubing in the wellbore based on each of: the initial reference, the input sensed angular position of the coiled tubing spool, the input radius and/or diameter of the outer wind of the coiled tubing on the coiled tubing spool, and the input estimated depth of the reference point of the coiled tubing;

correlating the velocity of the coiled tubing and the angular velocity of the coiled tubing spool; and sending an alert signal to a coiled tubing drive controller when the velocity of the coiled tubing and the angular velocity of the coiled tubing spool do not correlate within a predefined variation tolerance.

8. The method claim 7, wherein establishing the initial reference comprises stabbing the reference point of the coiled tubing into at least one of a blowout preventer (BOP) stack or a completion Christmas tree.

9. The method of claim 7, further comprising receiving an input collar location signal, wherein determining the depth of the reference point of the coiled tubing in the wellbore is further based on the input collar location signal.

10. The method of claim 9, further comprising determining an amount of stretch or an amount of compression in the coiled tubing based on correlating the input sensed angular position of the coiled tubing spool and the input collar location signal when running the coiled tubing into the wellbore with the input sensed angular position of the coiled tubing spool and the input collar location signal when pulling the coiled tubing out of the wellbore.

11. A method of determining a depth in a wellbore of a reference point associated with a coiled tubing on a coiled tubing spool, the method comprising:

establishing an initial reference for an angular position of the coiled tubing spool;

receiving an input sensed angular position of the coiled tubing spool, wherein the input sensed angular position of the coiled tubing spool is determined by an angular position sensor coupled to the coiled tubing spool;

receiving an input radius and/or diameter of an outer wind of the coiled tubing on the coiled tubing spool, wherein the input radius and/or diameter of the outer wind of the coiled tubing on the coiled tubing spool is determined by a winding sensor coupled to the coiled tubing spool; and determining the depth of the reference point of the coiled tubing in the wellbore based on each of: the initial reference, the input sensed angular position of the coiled tubing spool, and the input radius and/or diameter of the outer wind of the coiled tubing on the coiled tubing spool; and performing, in response to determining the depth of the reference point of the coiled tubing in the wellbore, a wellbore service operation at the determined depth.

12. The method of claim 11, wherein the wellbore service operation is at least one of a perforation operation, a cementing operation, a packer setting operation, a gravel packing operation, a fracturing operation, a casing wall cutting operation, a whipstock setting operation, or a completion tool setting operation.

13. A method of running coiled tubing from a coiled tubing spool into a wellbore, the method comprising:

driving the coiled tubing in one of a downhole direction or an uphole direction in the wellbore;

determining a first estimate of a velocity of the coiled tubing based on a first input received from a contact sensor contacting the coiled tubing;

determining a second estimate of the velocity of the coiled tubing based on each of:

a second input received from an angular position sensor coupled to the coiled tubing spool, the second input representing an angular position of the coiled tubing spool; and a third input received from a winding sensor coupled to the coiled tubing spool, the third input representing a radius and/or diameter of an outer wind of the coiled tubing on the coiled tubing spool;

correlating the first estimate of the velocity of the coiled tubing with the second estimate of the velocity of the coiled tubing; and sending an alert signal to a coiled tubing drive controller when the first estimate of the velocity of the coiled tubing and the second estimate of the velocity of the coiled tubing do not correlate within a predefined variation tolerance.

14. The method of claim 13, further comprising determining a depth of a reference point associated with the coiled tubing based on:

the second input representing the angular position of the coiled tubing spool; and the third input representing the radius and/or diameter of the outer wind of the coiled tubing on the coiled tubing spool.

15. The method of claim 14, wherein determining the depth of the reference point of the coiled tubing comprises determining an incremental coiled tubing payout or takeup that has occurred since a previous determination of the depth of the reference point of the coiled tubing, the payout or takeup based on each of:

an incremental angular displacement of the coiled tubing spool;

an incremental radius and/or diameter of the outer wind of the coiled tubing on the coiled tubing spool; and the previous determination of the depth of the coiled tubing.

16. The method of claim 13, further comprising halting driving the coiled tubing when the first estimate of the velocity of the coiled tubing does not correlate with the second estimate of the velocity of the coiled tubing within the predefined variation tolerance.

17. The method of claim 13, wherein the angular position sensor retains the angular position of the coiled tubing after an electrical power outage.

18. The method of claim 17, wherein the angular position sensor comprises a servomotor.

* * * * *